United States Patent [19]

Bogaert

[11] 4,090,437

[45] May 23, 1978

[54] OPENING-DEVICES FOR SMOKE- AND HEAT-VENTS

[76] Inventor: Pierre Emmanuel Eugène Jean Bogaert, 18, Dijk, Wemmel, Belgium

[21] Appl. No.: 705,878

[22] Filed: Jul. 16, 1976

[30] Foreign Application Priority Data

Jul. 18, 1975 Belgium ..... 831558

[51] Int. Cl.[2] ..... F23L 17/02

[52] U.S. Cl. ..... 98/86; 49/1; 49/7; 49/8; 98/42 R

[58] Field of Search ..... 98/42 R, 83, 43 R, 85, 98/43 C, 86, 42 A, 116; 126/287.5; 49/7, 8, 4, 1, 31, 3; 160/1, 2, 7, 9; 137/72–75

[56] References Cited

U.S. PATENT DOCUMENTS

| | | | |
|---|---|---|---|
| 3,182,581 | 5/1965 | Poederoyen et al. | 98/86 |
| 3,337,991 | 8/1967 | Adams | 98/86 |
| 3,516,198 | 6/1970 | Lyons | 49/1 |
| 3,601,437 | 8/1971 | Lyons | 98/86 |
| 3,738,253 | 6/1973 | Jentoft | 98/86 |
| 3,877,173 | 4/1975 | Lyons | 49/7 |

FOREIGN PATENT DOCUMENTS

| | | | |
|---|---|---|---|
| 2,337,459 | 4/1974 | Germany | 49/7 |

*Primary Examiner*—John J. Camby
*Assistant Examiner*—Henry C. Yuen

[57] ABSTRACT

Compact and autonomous device of high power for the opening of a smoke and heat vent, placed between the fix and the opening frame of the vent and composed of a fix arm forming the fix frame and a pivoting arm, the opening force being transmitted to the opening frame by means of a hinge fixed on a fitting piece gliding in the pivoting arm, which is retained in a closed position by means of a pivoting hook, driven by different pulling means, among which a pivoting lever kept in a retaining position by an electro-magnet, all forces and tensions being entirely taken up within the autonomous device and working in vertical and parallel planes, which are very close to one another. (Figure 1)

10 Claims, 8 Drawing Figures

FIG. 1
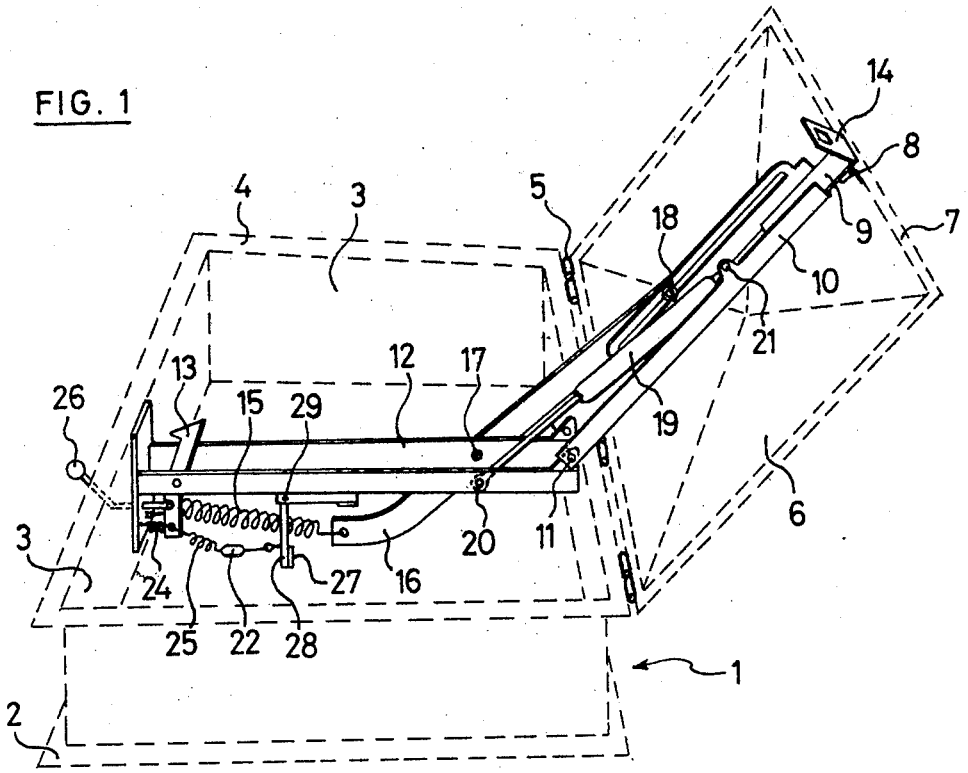
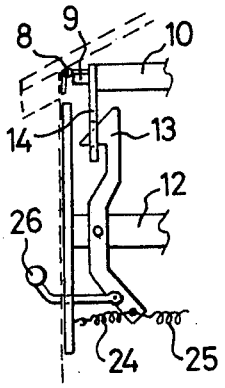
FIG. 3
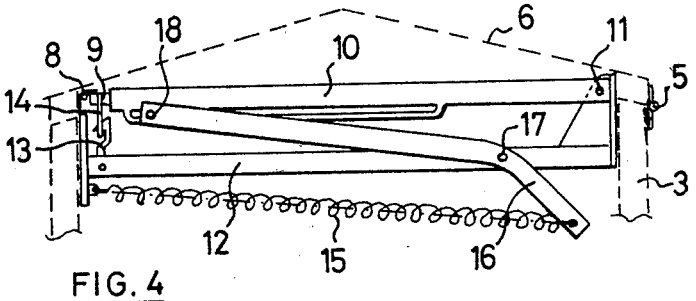
FIG. 4
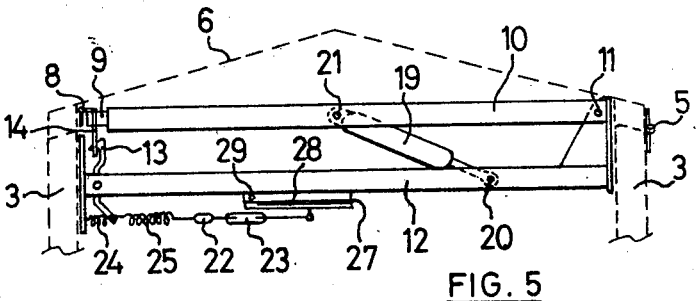
FIG. 5

OPENING-DEVICES FOR SMOKE- AND HEAT-VENTS

The present invention relates to improvements in opening-devices for smoke- and heat-vents, mostly used in combination with a fusible retaining means of these vents, as well as with different systems of smoke and heat detectors releasing the self-opening of said vents in the event of a fire.

In present day construction methods smoke and heat vents are increasingly required in accordance with regulations of fire-protection and have to satisfy more and more strict criteria imposed by the insurance companies assisted by quality control committees, causing thus numerous problems to the manufacturers.

Indeed, the opening of the vents must be possible under any conditions, in particular when covered by a thick layer of snow or ice, or when carying an overload of different objects fallen on them by accident. Hence it is necessary to provide very powerful devices capable of ensuring their opening under any circumstances. These devices must accumulate a sufficient energy to guarantee the immediate starting of the opening operation and to pursue it until completeopening. The forces involved must then be totally absorbed at the end of the stroke.

The power of the devices used requires a reinforcement and a systematic strengthening of such constituant parts of the fire-vents which are especially acted upon by very high tensions in a closed position and by the total absorption of these forces in an open position.

These problems of construction requirements led to the design of heavy, complicated and expensive fire-vents, all the constituent parts of which, and in particular the curb-sides, the hinges and the opening frame are constantly subject to important tensions. Futhermore the devices in use hitherto are complicated, involving so risks of frequent breakdowns or non-satisfying working.

The object of the present invention is to eliminate these disadvantages. It brings a very simple and economical solution to these problems by providing an opening device being compact, particularly strong, completely autonomous, mechanically compensated and which does not thus act upon the other elements of the vent, allowing so its manufacturing from much lighter materials, such as thin aluminium sheet and plastics. It allows a very easy mass production of autonomous devices (kits), which entails among other advantages a very considerable reduction of the production costs, a very easy installation on all sorts of curbs, a quick and simple transformation of existing rooflights, originally not foreseen for this purpose, into automatic smoke- and heat-vents, the achieving of an optimal functional efficiency together with an aesthetical appearance of residential type.

The device according to the invention is mainly characterized by the fact that it forms a complete and independant unity to be mounted between the fixed part and the opening frame of the fire vent and that it is composed of at least one fixed arm and at least one pivoting arm driven by a very powerful, compact and autonomous device, in which the opening force does not rest upon the whole fixed part of the fire-vent, but only upon the fixed arm, and does not apply directly on the opening part of the vent, but merely on the pivoting arm.

This force is transmitted to the end of the pivoting arm by means of an extensible element in order to exert itself exclusively upon the hinge fastened to the opening frame and located at the only point where the opening frame meets the extension of the pivoting arm. Retaining of the pivoting arm, in order to keep the fire-vent in closed position, is achieved by means of at least one pivoting hook, and the unlocking is effected by different traction means, for instance a pivoting lever kept in retaining position by an electro-magnet, the released energy being powerful at the start and weakened at the end of the stroke.

The invention will be better understood by reference to the following description and to the accompanying drawings which show, solely by way of example, some embodiments of the invention, wherein:

FIG. 1 is a diagrammatic view of the autonomous device after having worked and the fire vent having been brought in opened position.

FIG. 3 is a detail view.

FIGS. 4 and 5 show vertical section of the autonomous, mechanically compensated devices when having not yet worked.

FIG. 4 is a diagrammatic view of an embodiment of the device according to the present invention in which a spring is used as opening force and a gas or hydraulic-piston first as shock-absorber, and afterwards as the closing force.

FIG. 5 is a diagrammatic view of an embodiment in which a gas-piston as opening force and as shock-absorbed is used, the opening being effected by means of an electro-magnet.

Figure 2:
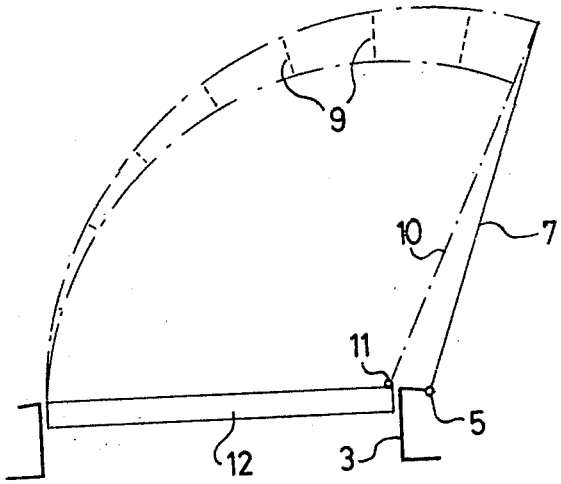
FIG. 2 shows diagrammatically the progressive advance of the gliding piece of the pivoting arm during the opening motion of the fire-vent.

According to the drawing a fire-vent comprises a curb 1 or fixed frame permanently fixed upon the roof-opening by a perimetric flange 2 and the sides 3 of which curb are surmounted by a rim 4, one side of which carries hinges 5, about which pivotes a cover 6 of the opening of the fire-vent, the frame 7 of which carries a hinge 8 fastened to a connecting part 9 gliding in a pivoting arm 10 fixed at 11 to the fixed arm 12. To said fixed arm is fastened a pivoting hook 13 (FIGS. 1 and 3) that is adapted to hook a retaining organ 14 fixed to part 9. Having now a general notion of the device it is easy to understand that by incorporating in it opening and retaining forces with the appropriate drives, it is possible to obtain a complete unit forming an autonomous and compact device suitable to be mounted and integrated as well on old as on new skylights, whose curb may be made of wood or light plastics.

The opening forces are formed either by springs 15, acting upon bent levers 16 pivoting at 17 about the fixed arm 12 and gliding at 18 in a guide provided on the pivoting arm 10 as shown on FIG. 4, or by gas-pistons 19 pivoting at 20 about the fixed arm 12 and acting at 21 upon the pivoting arm 10, as shown on FIG. 5, or by a combination of these two systems in order to obtain a much higher power, as shown on FIG. 1.

Figure 6:
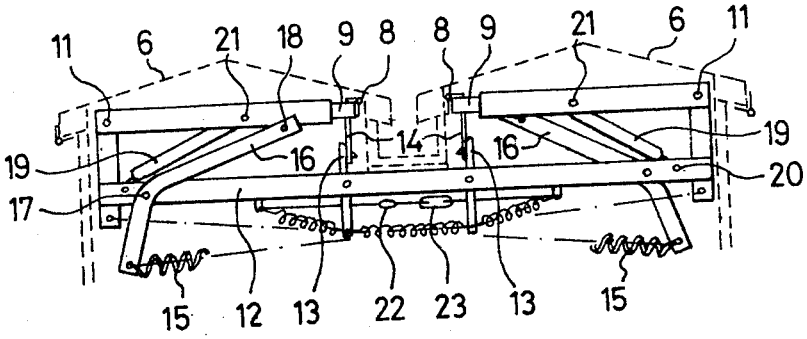
FIG. 6 shows diagrammatically an embodiment for large sized units, requiring a much more powerful opening force and comprising one fixed arm and two pivoting arms.

The vent with two covers shown in FIG. 6 comprises an opening-device with two pivoting arms fixed on one single fixed arm which is common to both and which allows the use of springs, which are much longer than the pivoting arms they drive, enabling so to produce a much higher power while guaranteeing a longer life of the springs.

The gas- or hydraulic- pistons 19 of FIGS. 1, 4 and 6 are, according to the needs, either of the pressure-brake type in order to increase the initial power and to absorb the shock at the end of the stroke, or exclusively of the absorber type when the opening force is sufficient at the start and too strong at the end of the stroke, or of the brake-pressure type in order to absorb the shock of the end of the stroke and to close the vent afterwards by reinjection of gas or liquid on mechanical operation. It is obvious that they can be used alone without spring mechanisms as on FIG. 5.

The power of the springs and pistons must always be carefully calculated with regard to the surface of the vent and to the requirements of the controlling mechanisms. The highest performances can be obtained by the autonomous device of the invention without creating any problem for the other constituent elements of the vent. Only the arms, the axis and the retaining systems of the autonomous devices must be calculated and adapted to fulfill the required performances, and all the tests can be easily executed in laboratory on the devices before mounting them on the cumbersome vents of very uneasy handling. So one understands easily the numerous advantages brought by the invention to the manufacturers.

As for the mechanical operation systems for the opening of the vent, they are formed by the member 14 retained by a pivoting hook 13 and by traction or pulling means on the hook 13 to maintain it in a locking or unlocking position.

Figure 7:
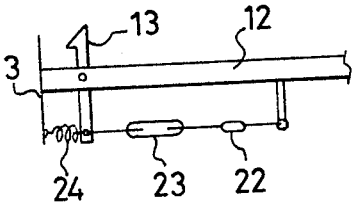
FIGS. 7 and 8 are views of details.
Figure 8:
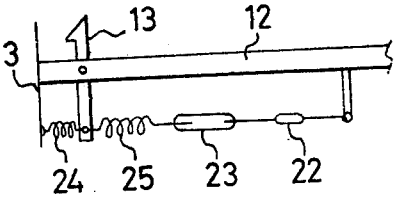

The most simple system (FIG. 7) comprises a fuse 22 advantageously placed in the centre of the vent, a stretcher 23 putting the spring 24 under tension in the closing position of the pivoting hook 13, the melting of the fuse under action of the heat starting the self-opening of the vent. This system is usually achieved by a second spring 25 (FIG. 8) and a mechanical or manuel drive 26 (FIG. 3), which allows a periodical control of the good working of the autonomous opening-device.

The opening of the vent can be operated by remote control by means of a circuit of liquid or gas under pressure injected into the piston 19. The reversal of the pressure in the piston allows the remote control of the closing of the vent.

The opening of the vent can also be operated by remote control by means of a low tension electric circuit connecting an installation of smoke and heat detectors with an electro-magnet 27 of very low power (FIGS. 1 and 5) maintaining against the fixed arm 12 the end of a small lever-arm 28 pivoting at 29 about this same fixed arm and connected by rods comprising a fuse 22, a stretcher 23 and a spring 24 or 25 to the pivoting hook 13.

Instead of transporting combersone vents from the mechanical construction shop, from there to the painting shop and then to the electricity shop, to pass then into the testing station, the invention brings a very simple and economic solution to all manufacturing problems. So it is on the building site, where the autonomous devices can very favourably be mounted into the curbs after the laying of the same into the roofing.

What I claim is:

1. In a smoke and heat vent having a first, fixed frame mounted to a roof opening, a second, pivoting frame pivotally mounted on said fixed frame, a device for opening said vent, said device comprising at least one fixed arm extending transversally inside said fixed frame and fastened at both ends to said fixed frame, at least one pivoting arm pivotally mounted at one of its ends on said fixed arm, means for attaching the other end said pivoting arm to said second frame, said means comprising a connecting member slidably mounted on said pivoting arm, a pivoting hook mounted on said fixed arm and adapted to hook said pivoting arm in closed position of said pivoting frame, means for unlocking said pivoting hook, means for producing a force for opening said pivoting frame, and means for absorbing said opening force at the end of its opening stroke, said opening force having its support on the fixed arm only and being transmitted to the end of the pivoting arm by said connecting member to the second, pivoting frame, said device forming a complete unit such that all stresses created by said force are contained within said device while said vent is kept free of said stresses.

2. An opening device according to claim 1, in which said means for attaching said pivoting arm to said pivoting frame also comprises a hinge fastened to said pivoting frame and to said connecting member.

3. An opening device according to claim 1, comprising a retaining member mounted on the pivoting arm, and traction driving means acting on said pivoting hook to keep it in a locking position, and means for unlocking said traction driving means.

4. An opening device according to claim 3, in which said unlocking means comprises a fusible link placed in said traction means and adapted to melt under the action of heat.

5. An opening device according to claim 3, in which a retaining member is mounted at right angles on the pivoting arm, and said driving means maintaining said pivoting arm on said fixed arm, the axis of the pivoting hook being placed in the plane formed by the retaining member.

6. An opening device according to claim 1, comprising an opening mechanism including a bent lever fixed at a pivoting point on said fixed arm, the pivoting arm being provided with a guide in which said bent lever is adapted to slide with one of its ends, a spring arranged so as to act on the other end of said bent lever and fixed to the latter, said other end being separated such a distance from the axis passing by the point of support of the lever on the pivoting arm and said pivoting point that the lever arm so formed in relation with the pivoting point is sufficient to produce a powerful starting impulse, and, separated from the pivoting point by such a distance that during the rotation and from the opening start, the opening moment is higher than the negative moment formed by the proper weight of the opening frame and keeping so in any intermediate opening position of the vent an almost constant moment until a predetermined opening starting from which this moment decreases, the spring forming finally a buffer, all opening forces, increasing and decreasing, as and internal tensions of the mechanism operating in parallel planes, which are close to one another, to thereby prevent distortion of the constituent elements of the vent.

7. An opening device according to claim 6, wherein said mechanism forming the opening force is provided with a shock-absorber for the end of the stroke.

8. An opening device according to claim 6, wherein the opening force is formed by a gas-piston resting on the fixed arm and acting on the pivoting arm, said two arms being formed by opposite U sections assembled so as to form the seating of the gas-piston, said gas-piston acting as a shock-absorber at the end of the stroke.

9. An opening device according to claim 1, wherein the opening force is formed by a spring driving a bent lever and by a gas-piston also acting as shock-absorber at the end of the stroke.

10. An opening device according to claim 1, comprising a fraction device for manually unlocking said pivoting hook and spring rods connected to said pivoting hook in order to unlock the same, as well as the pivoting arm.

* * * * *